US007618119B2

(12) United States Patent
Shibata et al.

(10) Patent No.: US 7,618,119 B2
(45) Date of Patent: Nov. 17, 2009

(54) INK JET PRINTING APPARATUS, INK JET PRINTING METHOD AND PRINT HEAD

(75) Inventors: Tsuyoshi Shibata, Yokohama (JP); Seiichiro Karita, Toda (JP); Hiroyuki Ogino, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 125 days.

(21) Appl. No.: 11/009,073

(22) Filed: Dec. 13, 2004

(65) Prior Publication Data

US 2005/0140722 A1 Jun. 30, 2005

(30) Foreign Application Priority Data

Dec. 15, 2003 (JP) ..... 2003-417361
Oct. 22, 2004 (JP) ..... 2004-308822

(51) Int. Cl.
*B41J 2/21* (2006.01)

(52) U.S. Cl. ..... 347/43; 347/40

(58) Field of Classification Search ..... 347/40–43, 347/6, 19–20, 43.2
See application file for complete search history.

(56) References Cited

U.S. PATENT DOCUMENTS 5,757,400 A 5/1998 Hoisington
5,771,052 A 6/1998 Hine et al.
5,880,756 A * 3/1999 Ishii et al. ..... 347/40
5,923,348 A 7/1999 Cunnagin et al.
6,172,689 B1 1/2001 Cunnagin et al.
6,244,688 B1 * 6/2001 Hickman ..... 347/43
6,328,418 B1 * 12/2001 Yamada et al. ..... 347/40
6,502,920 B1 1/2003 Anderson et al.
6,533,382 B1 3/2003 Tomida et al.
6,582,047 B2 6/2003 Koitabashi et al.
6,793,319 B2 * 9/2004 Ikemoto et al. ..... 347/40
6,834,926 B2 12/2004 Shibata
6,960,036 B1 11/2005 Fujita et al.
7,192,118 B2 * 3/2007 Kojima et al. ..... 347/40
2004/0104951 A1 6/2004 Shibata et al.
2004/0119766 A1 6/2004 Shibata et al.

FOREIGN PATENT DOCUMENTS

JP 10-250059 9/1998
JP 10-508808 9/1998
JP 11-020175 1/1999
JP 2000-507522 6/2000
JP 2001-129985 5/2001
JP 2003-521401 7/2006

* cited by examiner

*Primary Examiner*—Thinh H Nguyen
(74) *Attorney, Agent, or Firm*—Fitzpatrick, Cella, Harper & Scinto

(57) ABSTRACT

An ink jet print head is provided which can print a high-quality image with no density variation-caused lines at high speed and which can be manufactured at low cost and with ease. For this purpose, the print head of this invention has a plurality of nozzle groups each having at least one nozzle array arranged in a predetermined array direction Y crossing a relative motion direction X. A distance in the relative motion direction between the nozzles in each nozzle group adjoining each other in the array direction Y is set almost equal to a distance in the relative motion direction between the nozzle groups adjoining each other in the array direction Y.

3 Claims, 13 Drawing Sheets

INK JET PRINTING APPARATUS, INK JET PRINTING METHOD AND PRINT HEAD

BACKGROUND OF THE INVENTION

1. Field of the Invention

The present invention relates to an ink jet print head having nozzles densely arrayed therein to eject ink containing a colorant, and to an ink jet printing apparatus and an ink jet printing method to form an image using the print head. More specifically, the present invention relates to an ink jet printing apparatus and an ink jet printing method using an elongate print head which has a plurality of nozzle groups each made up of an array of nozzles arranged staggered between two parallel lines, one on an upstream side and the other on a downstream side with respect to a direction in which a print medium is moved relative to the print head. Particularly, this invention relates to an ink jet printing method, an ink jet printing apparatus and a print head suited for a so-called one-pass printing in which the elongate print head is scanned only once over a print area to complete a printed image.

This invention is applicable to all devices that print on print mediums made of paper, cloth, nonwoven fabric, OHP sheets and metal materials. Examples of applicable devices include office equipment such as printers, copying machines and facsimiles, and industrial manufacturing equipment.

2. Description of the Related Art

As information processing equipment, such as copying machines, word processors and computers, and communication equipment make technological advances, ink jet printing apparatus that print digital images by an ink jet method are becoming increasingly widespread as an image recording device for these equipment. One of the ink jet printing apparatus is known to use a print head that has a plurality of print elements (also referred to as nozzles) densely arrayed therein to increase a print speed. Further, in recent years there is a growing demand for a capability to print color images and, in response to this demand, printing apparatus that use a plurality of print heads for ejecting color inks are in common use. What is meant by a nozzle as referred to in this specification and the scope of claim is one that includes an ink ejection opening to eject ink supplied into a common ink chamber in the print head, an ink path to introduce ink supplied into the common ink chamber to the ink ejection opening, and an ejection energy generation element to eject ink supplied to the ink path from the ink ejection opening.

Generally, an ink jet printing apparatus ejects ink or recording liquid in the form of flying ink droplets onto a variety of print mediums made of such material as paper to form an image thereon. Since the ink jet printing apparatus adopts a non-contact system by which the print head does not contact the print medium, the printing can be performed with low noise. Another advantage is that the print resolution and the print speed can be increased by increasing the nozzle density. Further, the ink jet printing apparatus does not need special processing, such as development and fixing, even for such print mediums as plain paper. All these advantages allow for the printing of images at low cost and at high quality and therefore the ink jet printing apparatus is finding an ever widening range of applications. An on-demand type ink jet printing apparatus in particular has the advantages of being able to be easily upgraded to print color images and be reduced in size and simplified in construction and thus its demand is expected to expand in the future. As a demand for a capability to print color images grows, so does the need for higher print quality and faster print speed.

With a remarkable advance in recent years in the technology to form nozzles with high density, a fabrication of a high-density, elongate print head has come to be realized. An elongate print head having nozzles arrayed at high density is generally called a full-multi type elongate print head An ink jet printing apparatus using such an elongate print head has been proposed and implemented which completes a printed image in one printing scan over a wide print area corresponding to the elongate print head. This ink jet printing apparatus can meet requirements for both print speed and print quality. Because of these advantages, further efforts for development are being made on this type of printing apparatus.

However, the ink jet printing apparatus using the elongate print head with high-density nozzles has the following problems.

First, in the above system if an image in a print area is to be completed in one printing scan (one pass) or in a small number of passes, ink droplets ejected from the nozzles of print head units need to be absorbed and fixed in the print medium in a short period of time. This requires a bulky heat and dry means for the print medium or a means to reduce a volume of ink used for printing. This in turn increases cost and reduces the print density or pixel density, degrading the quality of the printed image.

Second, if the nozzles are arrayed at high density in a single line, ink droplets ejected from the adjoining nozzles may merge together on the print medium into an inappropriate shape. When an image to be printed has a high duty, the ink that failed to be absorbed in the print medium may remain on the print medium in a liquid state, degrading the print quality.

Third, ink dots formed by those nozzles in a boundary portion between the nozzle groups may produce artifacts such as streaking caused by optical density variations which shows up in the form of white or black lines, degrading a print quality.

To avoid this problem, a print head has been proposed which has nozzle groups each having two parallel lines of nozzles, one on an upstream side and one on a downstream side, so that the nozzles are staggered alternately between the upstream and downstream parallel lines. Further, in this configuration, the nozzle groups are connected longitudinally to form an elongate head for use in a full-line printer.

In an ink jet printing apparatus using the above print head having a plurality of longitudinally connected nozzle groups, however, a problem has been observed. Although white or black lines are rendered less conspicuous in an image area printed by those nozzles in one nozzle group, an image area printed by those nozzles in the boundary portion between the nozzle groups may still show white or black lines. A satisfactory image quality has yet to be obtained with this type of ink jet printing apparatus.

SUMMARY OF THE INVENTION

An object of this invention is to provide an elongate print head which can print a high-quality image with no density variation-caused lines at high speed and which can be manufactured at low cost and with ease and to provide an ink jet printing apparatus and an ink jet printing method using this print head.

Another object of this invention is to provide an ink jet printing apparatus for forming an image on a print medium by moving a print head having a plurality of ink ejection nozzles relative to the print medium as the print head ejects ink from the nozzles during a printing operation; wherein the print head comprises a plurality of nozzle groups each having at least one nozzle array arranged in a predetermined array direction crossing the print head-print medium relative motion direction; wherein a distance in the relative motion direction between the nozzles adjoining each other in the array direction in each nozzle group is set almost equal to a distance in the relative motion direction between the nozzle groups adjoining each other in the array direction.

A still another object of this invention is to provide a print head having a plurality of ink ejection nozzles, comprising: a plurality of nozzle groups each having at least one nozzle array arranged in a predetermined array direction crossing a relative motion direction, the relative motion direction being a direction in which the print head is moved relative to a print medium during a printing operation; wherein a distance in the relative motion direction between the nozzles adjoining each other in the array direction in each nozzle group is set almost equal to a distance in the relative motion direction between the nozzle groups adjoining each other in the array direction.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, preferred embodiments of this invention will be described in detail by referring to the accompanying drawings.

Figure 1:
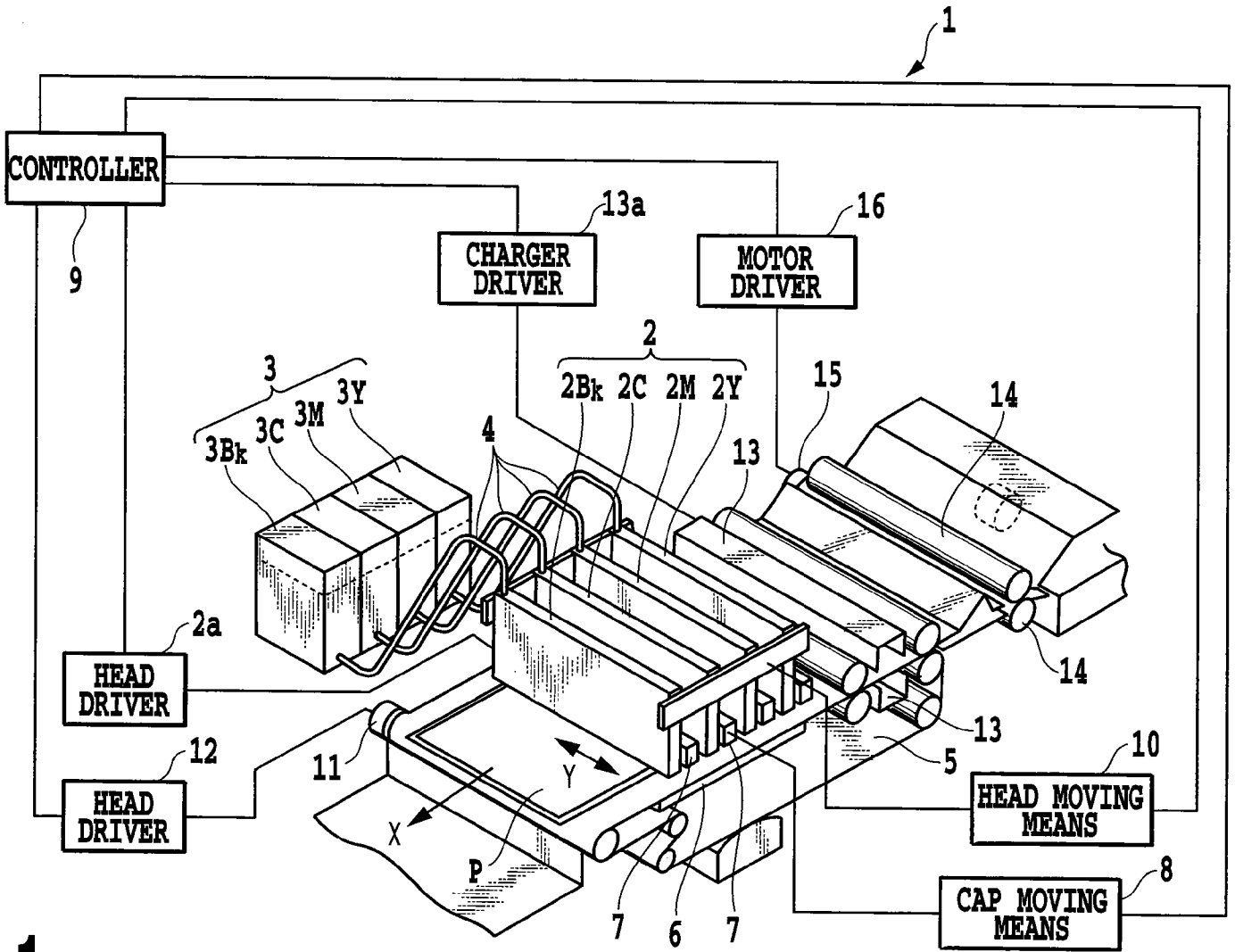
FIG. 1 is a schematic view showing a conceptual construction of an ink jet printing apparatus applied to an embodiment of this invention.
Figure 2:
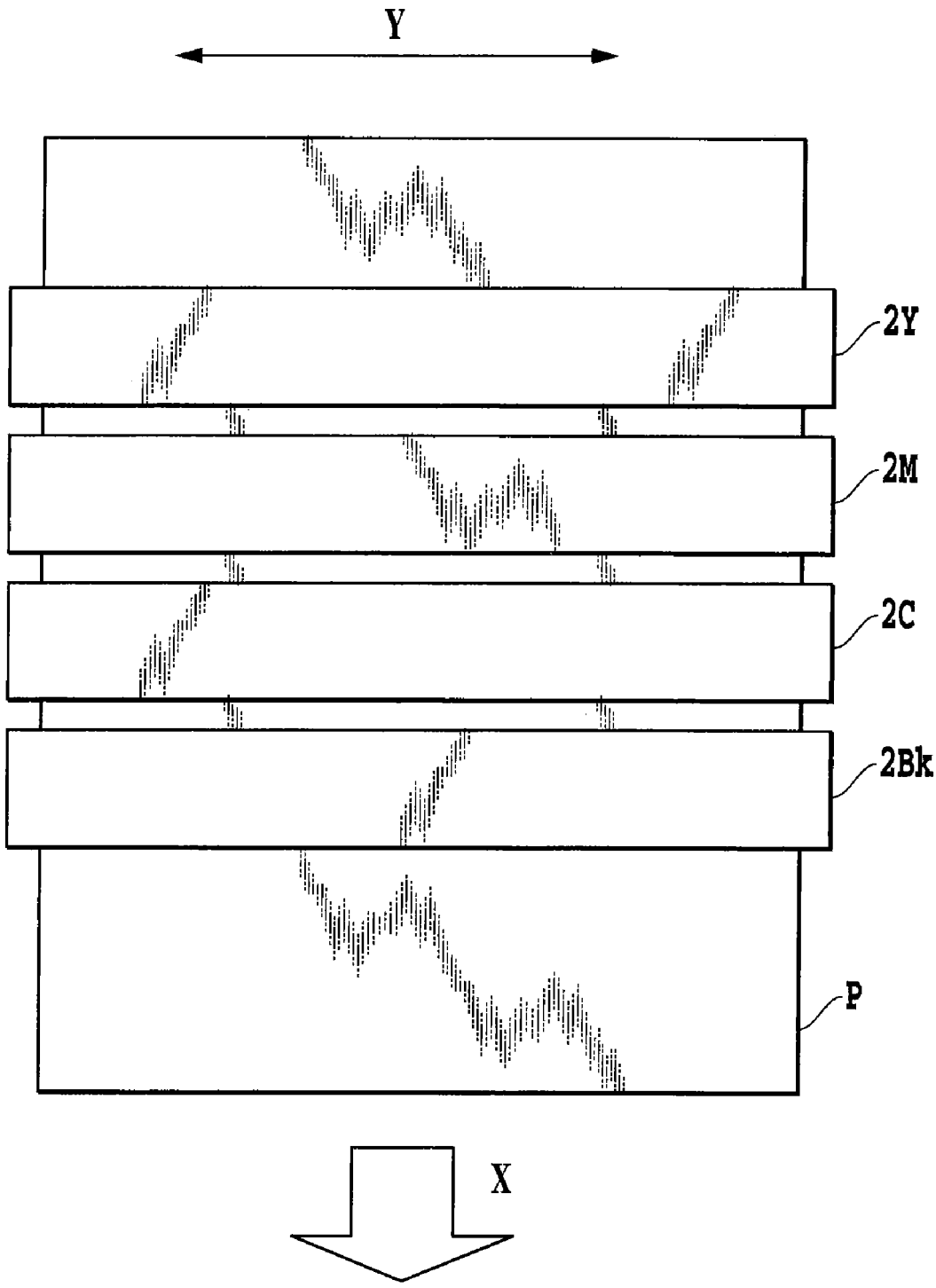
FIG. 2 is a plan view schematically showing an arrangement of print heads.

FIG. 1 is a schematic diagram showing a conceptual construction of an ink jet printing apparatus applied to embodiments of this invention. FIG. 2 is a plan view schematically showing an arrangement of print heads.

An ink jet printing apparatus 1 of this embodiment is a color ink jet printing apparatus having a plurality of parallelly arranged elongate print heads 2Y, 2M, 2C, 2BK extending in a direction perpendicular to a direction of feed of a print medium. Denoted 2Y is a print head to eject a yellow ink, 2M a print head to eject a magenta ink, 2C a print head to eject a cyan ink, and 2Bk a print head to eject a black ink. These print heads have almost the same construction and thus, unless otherwise specifically stated, they are generally described as a print head 2.

These print heads 2 are connected to four ink tanks 3Y, 3M, 3C, 3Bk (hereinafter referred to generally as an ink tank 3) containing yellow, magenta, cyan and black inks, respectively, through connecting tubes 4. These ink tanks 3 are removable from the connecting tubes 4 for replacement.

The print heads 2 can be moved vertically toward and away from a platen 6 by a head moving means 10 dedicated for recovery processing that is controlled by a controller 9. The print heads 2 are arranged at a predetermined interval in a transport direction of an endless transport belt 5 in such a way that they face the platen 6 with the transport belt 5 interposed therebetween. The print head 2 is formed with ink ejection openings, a common ink chamber to which an ink is supplied from the ink tank 3, and ink paths for introducing the ink from the common ink chamber to individual ink ejection openings. In each ink path there is provided a nozzle that has an electrothermal transducer (heater) as an ejection energy generation means to generate thermal energy for ejecting the ink supplied. The heaters are electrically connected to a controller 9 through a head driver 2*a*. The energizing and de-energizing of the heaters is controlled according to an on/off signal (ejection/non-ejection signal) sent from the controller.

By the side of each print head 2 head caps 7 are arranged at the same intervals as, but shifted half a pitch from, the print heads to discharge viscous ink from the ink paths prior to performing a printing operation on a print medium P to recover an ejection performance of the print heads. The head caps 7 can be moved to directly under the print heads 2 by a cap moving means 8 controlled by the controller 9 to receive waste ink discharged form the ink ejection openings.

The transport belt 5 for feeding the print medium P is wound around drive rollers connected to a belt drive motor 11, which is driven by a motor driver 12 connected to the controller 9. Upstream of the transport belt 5 is installed a charger 13 that charges the transport belt 5 to bring the print medium P into intimate contact with the transport belt 5. The charger 13 is energized/de-energized by a charger driver 13*a* connected to the controller 9. A pair of feed rollers 14, 14 to feed the print medium P onto the transport belt 5 is connected to a feed motor 15 that drives the feed rollers 14, 14. The feed motor 15 is operated by a motor driver 16 connected to the controller 9.

In performing a printing operation on the print medium P, the print heads 2 are first lifted away from the platen 6. Next, the head caps 7 are moved to directly under the individual print heads 2 to perform the recovery operation and then returned to the standby position. After this, the print heads 2 are lowered toward the platen until they reach the print position. Then, the charger 13 is energized, and at the same time the transport belt 5 is driven, the print medium P is fed by the feed rollers 14, 14 onto the transport belt, and the print heads 2 are activated to form a color image on the print medium P.

Figure 3:
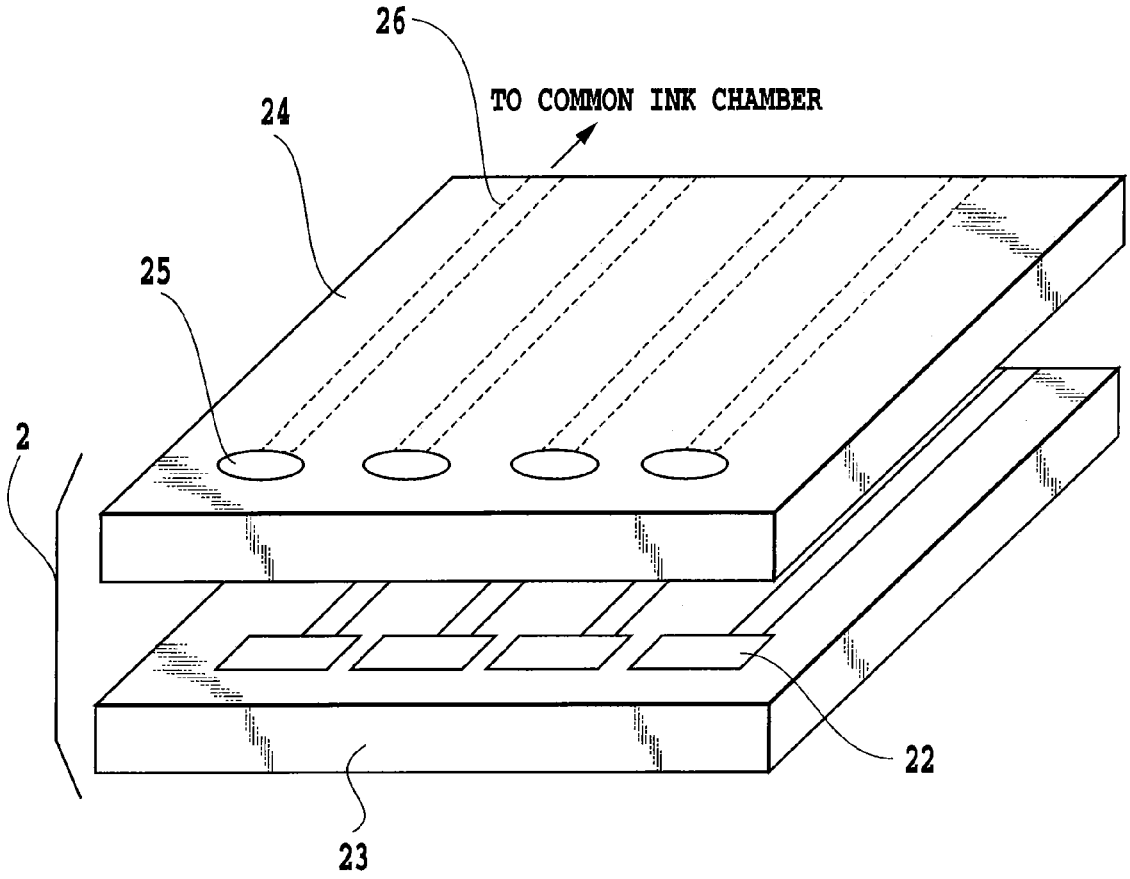
FIG. 3 is an exploded perspective view showing an inner construction of the print head of this invention.

Next, referring to FIG. 3, the inner construction of the print head 2 will be described.

In the figure, the ink jet print head 2 has a heater board 23 formed with a plurality of heaters 22 for heating ink and a top plate 24 mounted on the heater board 23. The top plate 24 is formed with a plurality of ink ejection openings 25. Behind each of the ink ejection openings 25 a tunnel-like ink path 26 is formed which communicates with the corresponding ink ejection opening 25. The ink paths 26 are commonly connected at their rear end to an ink chamber. The ink chamber is supplied an ink from the associated ink tank 3. The ink supplied to the ink chamber is then fed to individual ink paths 26.

The heater board 23 and the top plate 24 are assembled so that the heaters 22 align with the corresponding ink paths 26. The heaters 22, although only four of them are shown in FIG. 3, are assigned one to each ink path 26. In the assembled print head, when a predetermined drive pulse is applied to the heaters 22, ink over each heater 22 boils to produce a bubble which, as its volume expands, expels an ink droplet from the ink ejection opening 25. The ink jet printing system applicable to this invention is not limited to a so-called bubble jet (registered tradename) system that uses the heaters as shown in FIG. 1 and FIG. 2. For example, in the case of a continuous system that continuously ejects ink for drop formation, a charge control type and a diffusion control type may be applied. In the case of an on-demand system that ejects ink droplets on demand, a pressure control type that ejects ink drops from ink ejection openings by mechanical vibrations produced by a piezoelectric oscillation device can be applied.

Figure 4:
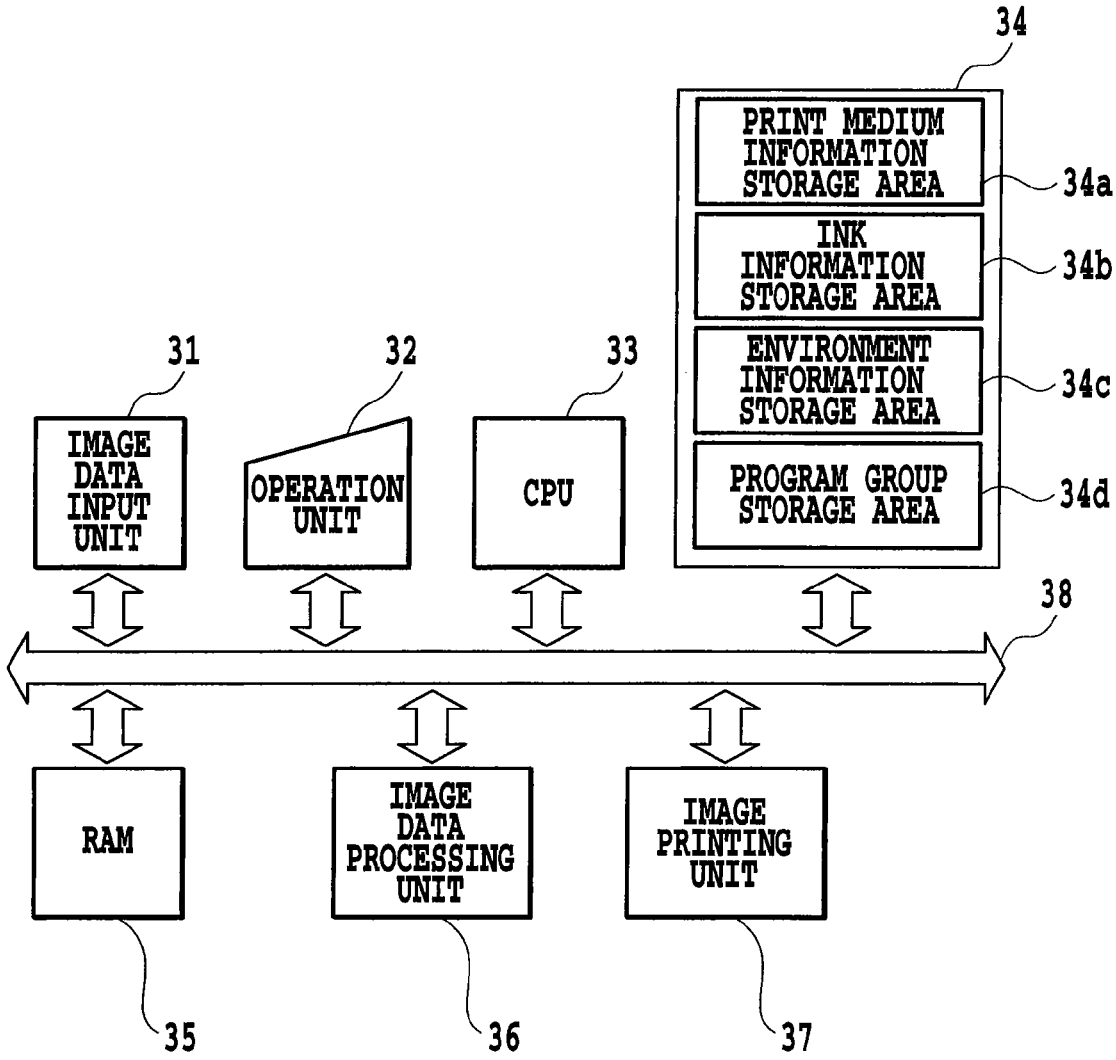
FIG. 4 is a block diagram showing an example configuration of a control system in the ink jet printing apparatus of this invention.

FIG. 4 is a block diagram showing an example configuration of a control system in the ink jet printing apparatus of this invention.

In FIG. 4, denoted 31 is an image data input unit to enter multi-valued image data from image input devices such as scanner and digital camera and multi-valued image data stored in a hard disk of a personal computer, 32 an operation unit having a variety of keys to set parameters and instruct a start of printing, and 33 a CPU as a control means to control the entire printing apparatus according to various programs in storage media. Reference number 34 represents a storage means for storing a variety of data. The storage means 34 has a print medium information storage area 34*a* to store information about the kind of print medium, an ink information storage area 34*b* to store information about ink used for printing, an environment information storage area 34*c* to store information on the environment at time of printing such as temperature and humidity, and a control program group storage area 34*d*. A RAM 35 is used as a work area for various programs in the storage means 34, as a temporary save area for processing errors, and as a work area for processing an image. In this embodiment all operations are performed according to the programs in the storage means. As the storage means 34 to store the programs, ROM, FD, CD-ROM, HD, memory card and magnetooptical disc may be used. The RAM 35 may also be used to copy various tables in the storage means 34 and then change the contents of the tables so that the image processing can be performed by referring to the modified tables.

Denoted 36 is an image data processing unit which quantizes input multi-valued image data into N-valued image data for each pixel and generates an ejection pattern according to Quantized grayscale values "K" of individual pixels. The image data processing unit 36 transforms input multi-valued image data into N-valued image data and then creates an ejection pattern that matches the grayscale values "K". For example, if 8-bit multi-valued image data (representing 256 grayscale levels) is supplied to the image data input unit 31, the image data processing unit 36 transforms grayscale values of the image data to be output into K values. While a multi-value error diffusion method is used in the process of transforming input grayscale image data to K values in this example, any desired half-tone processing method, such as average density storage method and dither matrix method, may be employed. Based on image density information, the transform-to-K-value processing is repeated for all pixels to generate binary drive signals dictating whether individual nozzles are to eject or not eject ink for each pixel.

Denoted 37 is an image printing unit 37 to eject ink according to the ejection pattern generated by the image data processing unit 36 to form a dot image on a print medium. Designated 38 is a bus line to transfer an address signal, data and control signal in the printing apparatus.

Next, referring to FIGS. 5A and 5B, FIG. 6 to FIG. 12, and FIGS. 13A to 13C, a nozzle arrangement in the print head, the feature of this invention, will be described. To clarify the feature of preferred embodiments of this invention, let us first describe a technology related to this invention and then explain the nozzle arrangement and the print head arrangement in the embodiments, focusing on differences between this invention and its related technology (Related Technology)

Figure 5A:
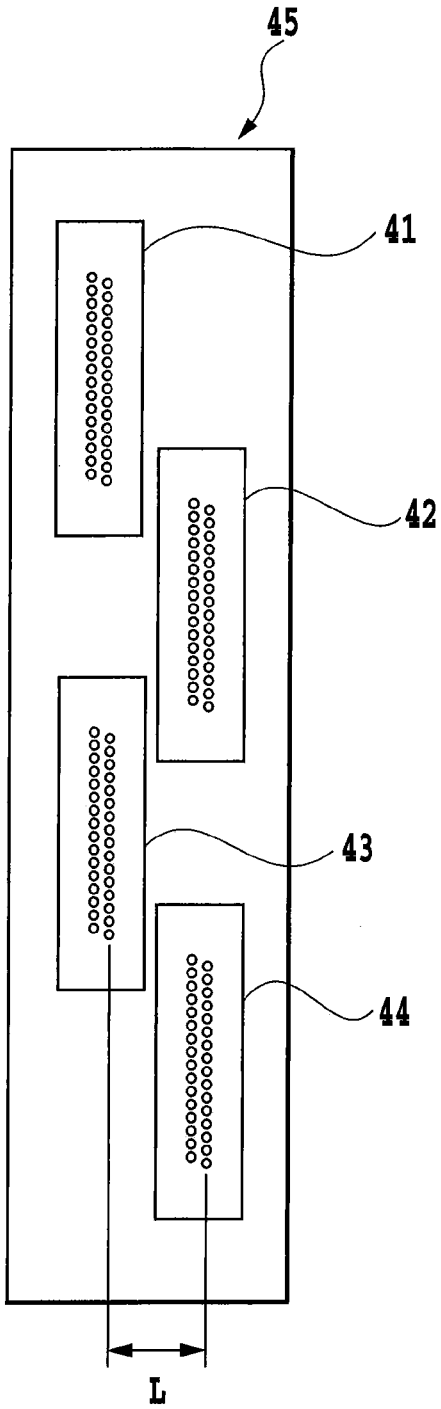
FIG. 5A is a schematic diagram showing a nozzle array in an elongate print head according to the related technology of this invention.
Figure 5B:
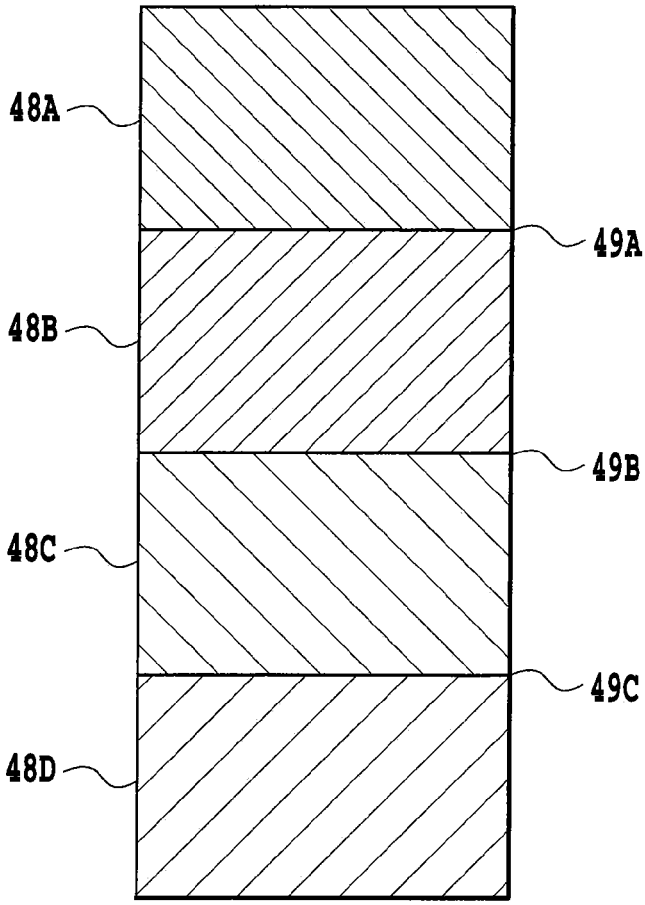
FIG. 5B illustrates an image printed using the print head of FIG. 5A.

FIG. 5A shows an elongate print head used for a full-line type ink jet print head and FIG. 5B illustrates an image printed by the print head of FIG. 5A.

In FIG. 5A, denoted 41 to 44 are head nozzle groups each having 512 nozzles arranged in two left and right arrays staggered from each other. These nozzle groups 41 to 44 are arranged staggered on left and right side alternately so that they collectively form an elongate print head 45. While the elongate print head 45 of FIG. 5A is shown to have a total of 2048 nozzles by connecting the four nozzle groups 41-44, it is possible to have three or four or more nozzle groups connected in one print head.

Here, how an image is formed by an ink jet printing apparatus using the elongate print head 45 will be described. The print data to be printed by the print head 45 is generated by separating an input image into individual colors for the corresponding heads and binarizing the color-separated gray image by the error diffusion method.

When a gray image, such as shown in FIG. 5B, is printed by the elongate print head 45, ink droplets from adjoining nozzles in each of the nozzle groups 41, 43 are ejected almost simultaneously and land on a print medium almost simultaneously to form printed regions 48A, 48C, although this process is somewhat affected by the ink ejection volume, the kind of ink and print medium and the print speed. A time duration later, which corresponds to a distance L, ink droplets from adjoining nozzles in each of the nozzle groups 42, 44 are ejected almost simultaneously to form printed regions 48B, 48D. At this time, at boundary portions 49A, 49B, 49C between the first-printed regions. 48A, 48C and the second-printed regions 48B, 48D, lines of different densities from other areas (in the figure, dark lines with higher optical densities than those of other areas) may be formed, significantly degrading the quality of image. In the following description, a line of different density than that of the surrounding area which shows at a boundary portion between adjacent image regions printed by different nozzle groups is referred to as a "joint line."

An elongate print head having all nozzles arrayed nearly in a line does not produce such joint lines as are formed by the print head of the above construction, and thus can perform a high quality printing. However, forming such an elongate print head with a single line of nozzles at a high nozzle density has many difficulties in the process of manufacture and will increase the manufacturing cost.

Figure 6:
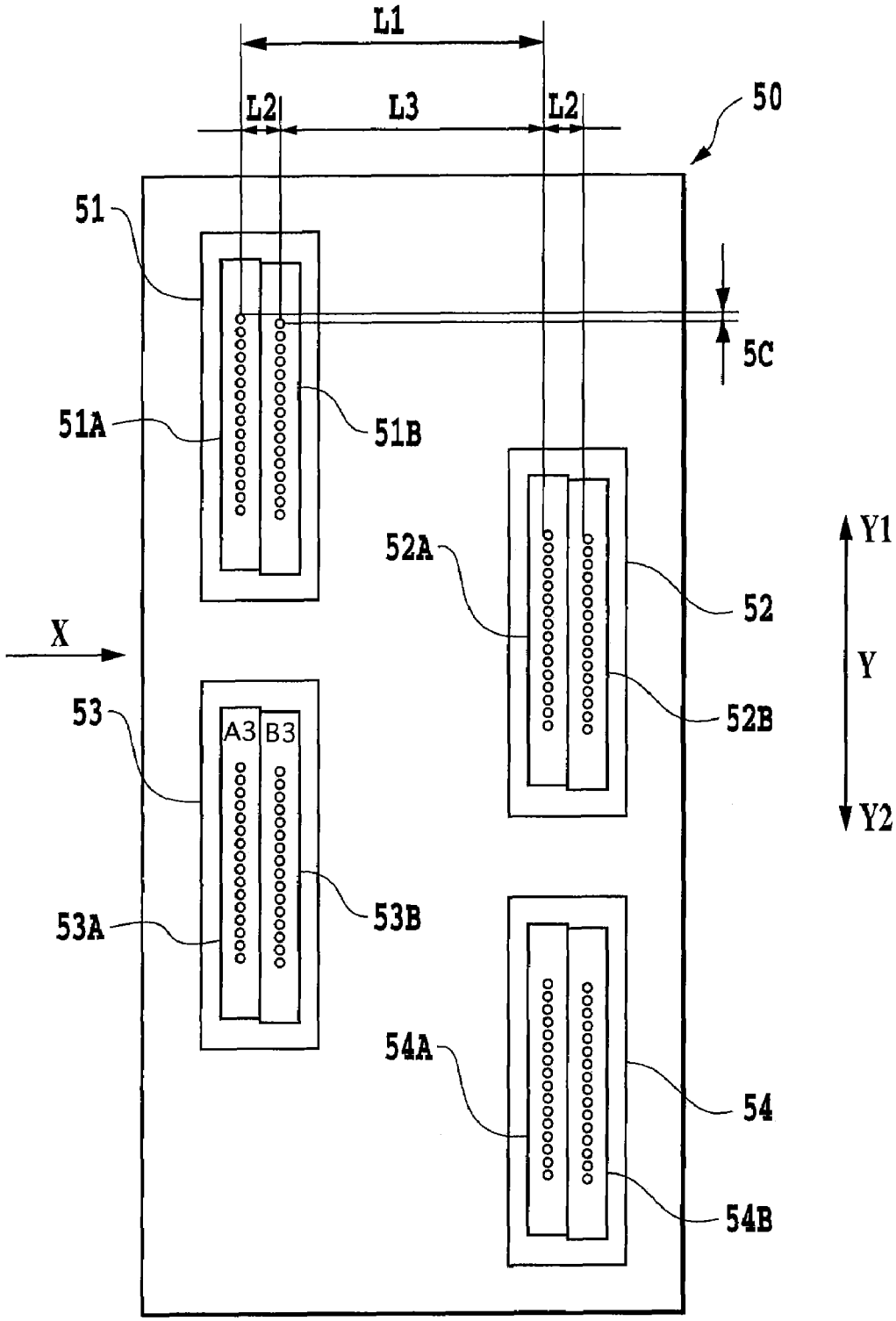
FIG. 6 is a schematic diagram showing another nozzle array in the elongate print head according to the related technology of this invention.

To deal with the above problem, it has been proposed and implemented to arrange relative short nozzle groups in left and right arrays alternately in a staggered manner to fabricate an elongate print head easily at low cost. That is, an elongate print head is manufactured by forming a plurality of short nozzle arrays that can be manufactured at relatively low cost using the known technology and arranging them in a staggered manner. With this method nozzles can be located at precise positions more easily than the method that arranges individually fabricated nozzle arrays in a single line and bond them to a substrate. The proposed method is also advantageous in terms of cost. FIG. 6 shows one such example.

A print head 50 shown in FIG. 6 is an elongate print head for a full-line type ink jet printing apparatus, which is made by forming each nozzle group as an integral, fixed structure and arranging these nozzle groups in a staggered manner. In the following, X represents a direction in which a print medium is transported relative to the print head and Y represents a direction perpendicular to the print medium transport direction X.

Further, the X direction is also called a print head/medium relative direction of motion, considering a case where the print medium is transported in one pass in one direction relative to the fixed full-line type ink jet print head during printing and also a case where the print medium is intermittently transported relative to the ink jet print head that is serially moved during the printing operation.

In this print head 50, two nozzle arrays 51A, 51B each having nozzles arrayed at equal pitches in the Y direction are laid upstream and downstream with respect to the X direction. These two nozzle arrays 51A, 51B form one nozzle group 51. The nozzles in the downstream nozzle array 51B are situated intermediate in the Y direction between the nozzles of the upstream nozzle array 51A. Thus, in one nozzle group, the upstream nozzles and the downstream nozzles adjoin each other in the Y direction, the nozzle array direction, and are staggered by a distance of 5C. In other words, the two nozzle arrays in one nozzle group form a staggered line of nozzles. This arrangement provides a print head with a high nozzle density in the Y direction, practically as high a nozzle density as if the nozzles were arrayed in a straight line at a pitch of 5C.

The print head 50 shown here has a total of four nozzle groups 51, 52, 53, 54 of the same construction as the nozzle group 51, arranged alternately on the upstream and downstream side with respect to the X direction so that they are connected staggered in the Y direction. The nozzles groups 51 and 53 assume the same position in the X direction and the nozzle groups 52 and 54 are also situated in the same position in the X direction.

Here, L1, L2 and L3 represent distances between nozzle arrays in the X direction. L1 represents a distance between the upstream nozzle arrays 51A, 53A of the upstream nozzle groups 51, 53 and the upstream nozzle arrays 52A, 54A of the downstream nozzle groups 52, 54; L2 represents a distance between the upstream nozzle array and the downstream nozzle array in each nozzle group; and L3 represents a distance between the downstream nozzle arrays 51B, 53B of the upstream nozzle groups 51, 53 and the upstream nozzle arrays 52A, 54A of the downstream nozzle groups 52, 54 (also referred to as a nozzle group distance).

In the print head 50 of the above construction, the distance L2 between the upstream and downstream nozzle arrays in each nozzle group and the distance L3 between the upstream and downstream nozzle groups differ greatly. Thus, of the dots that have landed on a print medium, those on boundary portions between image regions printed by adjoining nozzle groups have different dot densities than those of the surrounding areas, producing lines of density variations over the entire image, degrading the image quality. This is considered due to the following reasons.

When a printing operation is performed by the elongate print head 50, two adjoining dots formed on a print medium by ink droplets ejected from nozzles adjoining in the Y direction (simply referred to as adjoining nozzles) overlap at their connected ends to form a merged dot. This process is shown in FIGS. 13A, 13B and 13C.

Figure 13A:
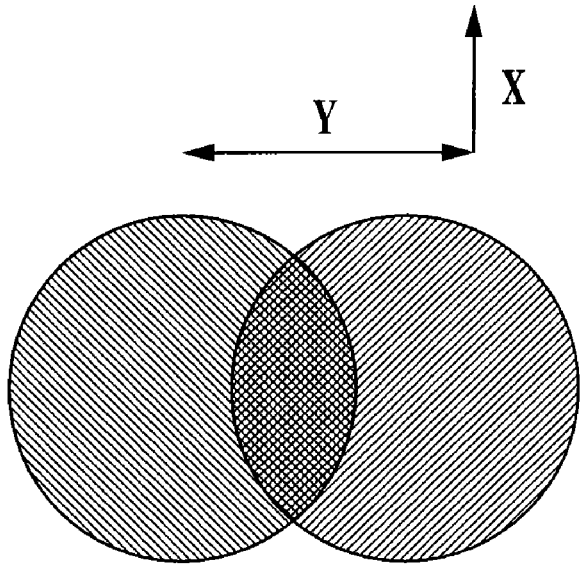
FIG. 13A, FIG. 13B and FIG. 13C are schematic diagrams showing how a merged dot is formed of two ink droplets ejected from two adjoining nozzles of the print head.
Figure 13B:
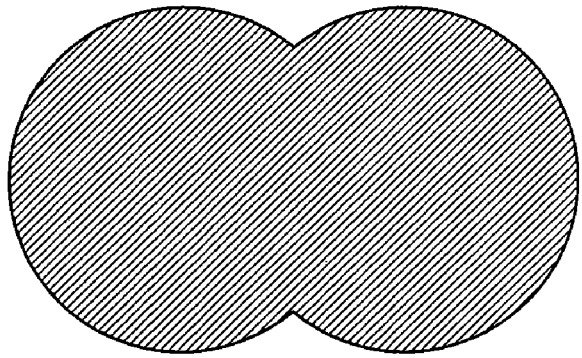
Figure 13C:
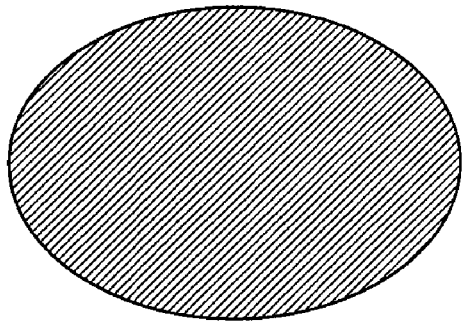

The merged dot assumes either a gourd-like shape as shown in FIG. 13A and FIG. 13B or an oval shape as shown in FIG. 13C.

FIG. 13A shows a merged dot formed by two adjoining dots that landed on the print medium with a relatively large time difference. An optical density of the overlapping portion of the gourd-shaped, merged dot is apparently higher than other portions. FIG. 13B shows a merged dot formed by two adjoining dots that landed with a shorter time difference than that of FIG. 13A. There is almost no difference in optical density between the overlapping portion of the two dots and other portions. FIG. 13C shows a merged dot formed by two adjoining dots that landed with an even shorter time difference than those of FIG. 13A and FIG. 13B. Upon landing, the ink of the two dots mixes to form an oval merged dot, rather than the gourd-shaped dot.

As described above, the optical density and shape of a merged dot formed on a print medium vary depending on the landing time difference between the adjoining dots that form the merged dot. When such a merged dot is formed continuously in the X direction in one image, a density difference appears as a white or black line (joint line), though its level of conspicuousness depends on variations in ink dot landing position. In other words, when the dots ejected from the nozzles in the boundary portion and the dots ejected from the nozzles in the non-boundary portion are all formed by one kind of the merged dot among the merged dots shown in FIGS. 13A, 13B and 13C in Y direction, the density difference (joint line) as mentioned above will not appear in X direction.

In the above print head 50, droplets ejected from the adjoining nozzles in each nozzle group land on a print medium with a relatively short time difference that corresponds to the distance L2. Thus, merged dots such as shown in FIG. 13B or FIG. 13C are formed. In a boundary portion between adjoining nozzle groups, however, droplets ejected from the adjoining nozzles land with a relatively large time difference, thus forming merged dots as shown in FIG. 13A. As a result, the boundary portion between adjacent image regions has a different optical density than the surrounding area. This density difference shows up as a line.

Figure 7:
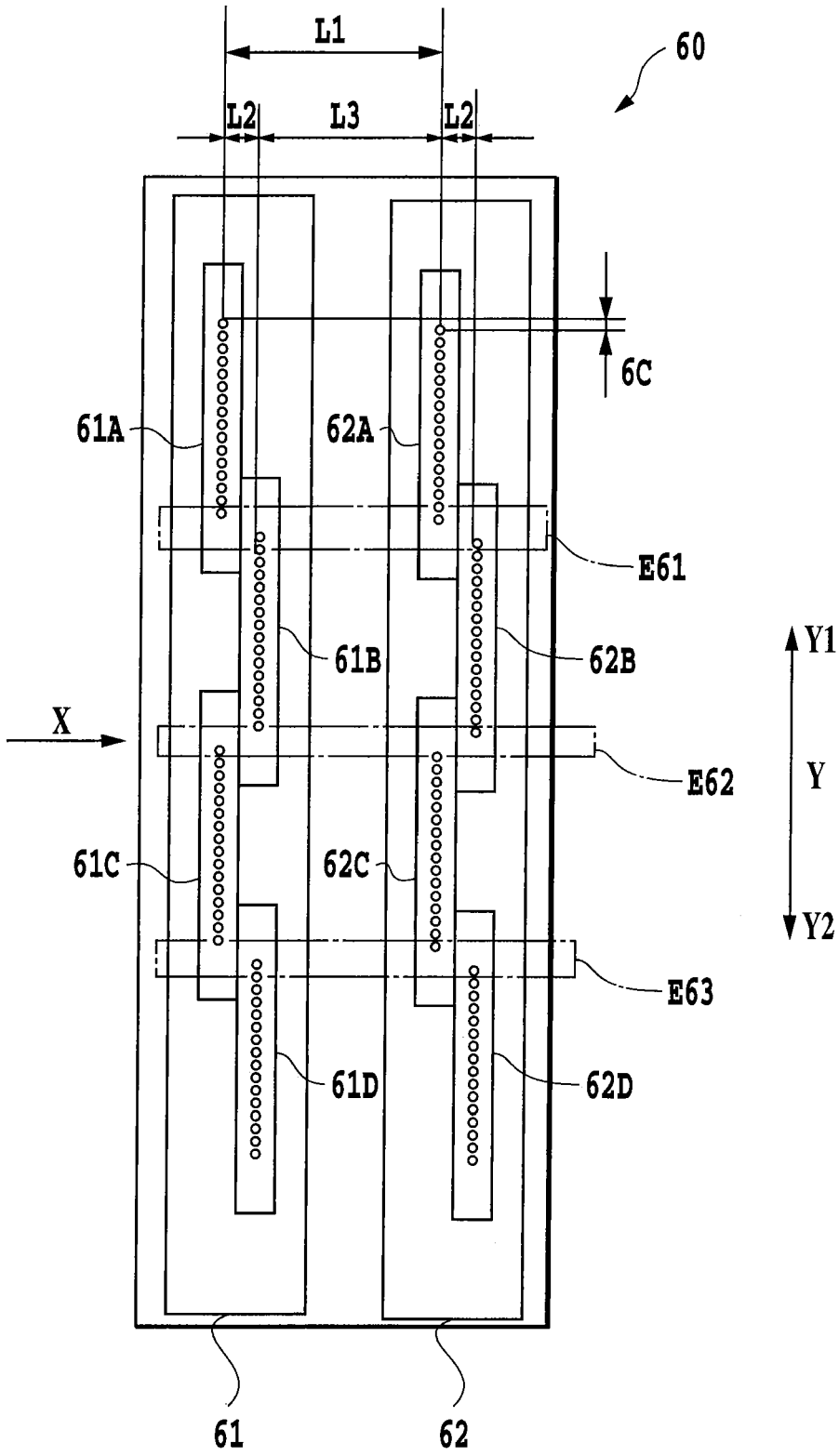
FIG. 7 is a schematic diagram showing still another nozzle array in the elongate print head according to the related technology of this invention.

As still another related technology, a print head 60 shown in FIG. 7 has been proposed. This print head 60 has two elongate head units 61, 62 arranged in upstream and downstream positions with respect to the X direction. In each of the elongate head units 61, 62, four nozzle arrays, each having nozzles arrayed in line in the Y direction, are shifted to upstream and downstream sides alternately and connected at their ends in the Y direction. The nozzles in the downstream elongate head unit 62 are staggered in the Y direction from the nozzles in the upstream elongate head unit 61 by a distance 6C, one-half the arrangement pitch of the nozzles in each nozzle array. Thus, when viewed as a whole, the print head 60 has its nozzles arrayed in the Y direction at intervals of 6C, which provides virtually the same nozzle density as if the nozzles were formed in a single line at the arrangement pitch of 6C.

The print head 60 of the above construction also has the similar problem described earlier. In the boundary portions E61, E62, E63 between the adjoining nozzle arrays, the distances between the adjoining nozzles in the Y direction differ from those of other nozzles. Therefore, merged dots formed by these adjoining nozzles have optical densities different from those of other merged dots, resulting in a joint line. That is, in the boundary portion E61, a lowermost nozzle (at a Y2-side end in the Y direction) of the nozzle array 62B ejects an ink droplet forming a dot. A short period of time later which corresponds to the distance L2, a nozzle at the Y1-side end of the nozzle array 61B ejects an ink droplet forming another dot. Then, a short time later which corresponds to the distance L3, a nozzle at the Y2-side end of the nozzle array 62A ejects an ink droplet forming another dot. After this, a short time later which corresponds to the distance L2, a nozzle at the Y1-side end of the nozzle array 62B ejects an ink droplet forming still another dot.

As described above, when merged dots are formed by the nozzles in the boundary portion E61 between the adjoining nozzle arrays, there is a slight difference between the time interval corresponding to the distance L1 and the time interval corresponding to the distance L3. Therefore, an overlapping portion of a merged dot, which is formed by a dot ejected from the nozzle at the Y2-side end of the nozzle array 62A and by a dot ejected from the nozzle at the Y1-side end of the nozzle array 61B, has a lower optical density than the overlapping portions of other merged dots. If this merged dot is formed successively in the X direction, a line of different density (joint line) extending in the X direction shows. It is known that the landing positions of ink dots ejected from end nozzles of each nozzle array are easily disturbed. This increases a possibility that an ink dot from the Y2-side end nozzle of the nozzle array 61A and an ink dot from the Y1-side end nozzle of the nozzle array 61B may merge together, making the formation of another joint line likely. These density variations similarly occur also in other boundary portions E62, E63.

Figure 8:
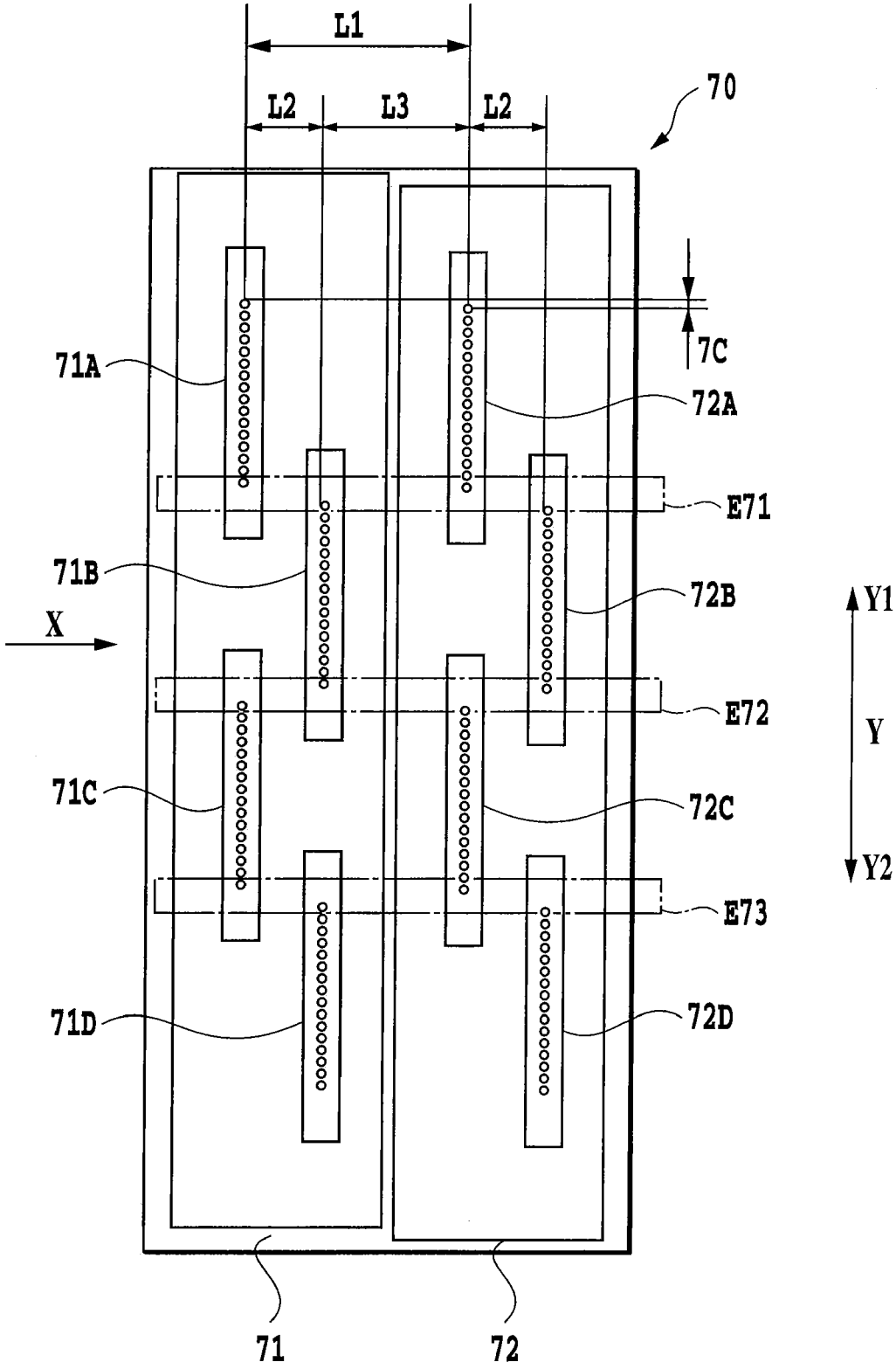
FIG. 8 is a schematic diagram showing yet another nozzle array in the elongate print head according to the related technology of this invention.

A further related technology, such as shown in FIG. 8, has been proposed.

A print head 70 shown here has two elongate head units arranged in parallel, each having four nozzle arrays arrayed in a staggered manner and connected at their ends, as with the print head 60 of FIG. 7. In this related technology, however, an upstream elongate head unit 71 has upstream nozzle arrays 71A, 71C and downstream nozzle arrays 71B, 71D separated a large enough distance in the X direction. Similarly, a downstream elongate head unit 72 has upstream nozzle arrays 72A, 72C and downstream nozzle arrays 72B, 72D separated a large enough distance in the X direction. With this arrangement, the nozzles in any of the border portions E71, E72, E73 between the adjoining nozzle arrays form adjoining dots in such a way that they overlap after the preceding dots have been fixed well. Thus, the merged dots are all formed as shown in FIG. 13A, producing a relatively good image. With this print head 70, however, the arrangement of signal lines is complicated for the reason described above and the head width in the X direction becomes large, increasing the size of the printing apparatus.

First Embodiment of this Invention

Figure 9:
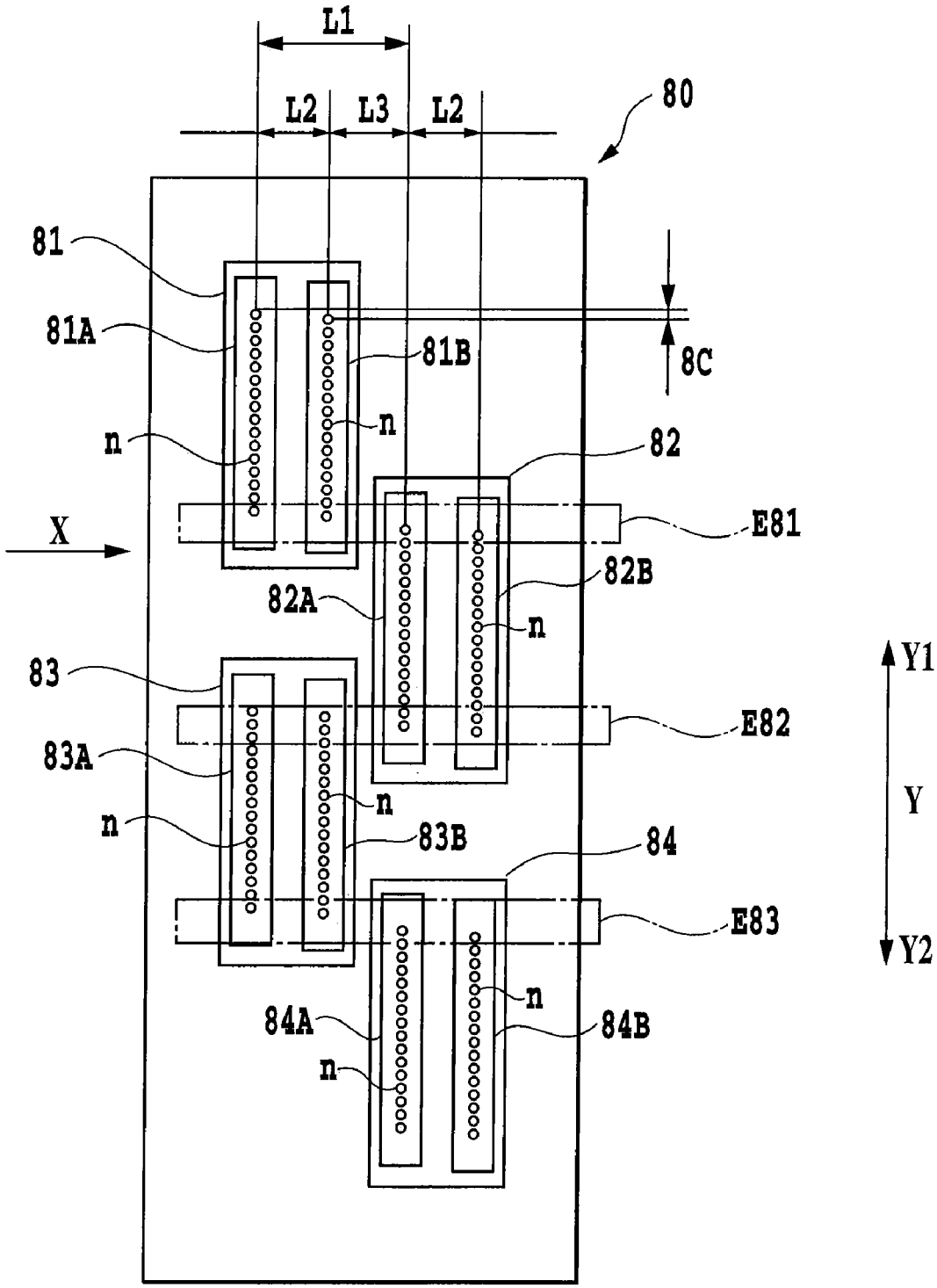
FIG. 9 is a schematic diagram showing a nozzle array of an elongate print head in a first embodiment of this invention.

To solve these problems experienced with the related technologies described above, the first embodiment of this invention provides a print head constructed as shown in FIG. 9 for use in the full-line type ink jet printing apparatus of FIG. 1.

In FIG. 9, reference numbers 81, 82, 83, 84 represent nozzle groups each made up of an odd-numbered nozzle array and an even-numbered nozzle array. These nozzle groups are alternately shifted to different positions in the X direction, i.e., to upstream and downstream side, and connected at their ends in the Y direction, thus forming an elongate print head 80 extending in the Y direction. Of these nozzle groups, the nozzle groups 81, 83 are situated in the same upstream position with respect to the X direction and the nozzle groups 82, 84 are likewise situated in the same downstream position with respect to the X direction. While in FIG. 9 the elongate print head 80 is shown to have four nozzle groups 81-84, it is possible to arrange three nozzle groups or four or more nozzle groups in one print head.

These nozzle groups have the same construction. For example, the nozzle group 81 has an odd-numbered nozzle array 81A and an even-numbered nozzle array 81B. The odd-numbered nozzle array 81A is made up of those of nozzles n arrayed at a predetermined pitch in the Y direction which are situated in odd-numbered positions from the upper end of the nozzle array; and the even-numbered nozzle array 81B is made up of those of the nozzles n which are situated in even-numbered positions from the upper end of the nozzle array (including a 0th position). The nozzles of the even-numbered nozzle array 81B are so arranged as to be situated intermediate in the Y direction between the nozzles of the odd-numbered nozzle array 81A. Thus, in one nozzle group, the nozzles in the odd-numbered nozzle array and the nozzles in the even-numbered nozzle array are situated close to each other in the Y direction in which the nozzles are arrayed, and their pitch is 8C. Thus, in this nozzle group 81 the nozzles n are arranged staggered in two nozzle arrays 81A, 81B, forming a high-density nozzle head. In other words, this construction can provide virtually the same nozzle density as if the nozzles were arrayed in a single line at the pitch of 8C. The nozzle arrays 81A, 81B are each formed in separate substrates, both of which are integrally supported by a support plate P.

L1, L2, L3 represent distances in the X direction between the nozzle arrays. L1 represents a distance between the odd-numbered nozzle arrays 81A, 83A in the upstream nozzle groups 81, 83 and the odd-numbered nozzle arrays 82A, 84A in the downstream nozzle groups 82, 84. L2 represents a distance between the odd-numbered nozzle array and the even-numbered nozzle array in each nozzle group. L3 represents a distance between the even-numbered nozzle arrays 81B, 83B in the upstream nozzle groups 81, 83 and the odd-numbered nozzle arrays 82A, 84A in the downstream nozzle groups 82, 84 (also referred to as a nozzle group distance). In FIG. 9, E81, E82 and E83 indicate boundary portions between the nozzle groups.

When printing a solid image using the print head 80 described above, in the boundary portion E81 between the nozzle groups, a nozzle at the Y2-side end in the Y direction of the nozzle array 81A first ejects an ink droplet. This is followed by a nozzle at the Y2-side end of the nozzle array 81B, by a nozzle at the Y1-side end of the nozzle array 82A and then by a nozzle at the Y1-side end of the nozzle array 82B in that order. Dots are formed by the ink droplets ejected from these nozzles successively.

The landing time difference between adjoining dots formed by the adjoining nozzles in each nozzle group 81, 82 matches the distance L2. This time difference is so set that two adjoining dots partly overlap each other to form a gourd-shaped merged dot, such as shown in FIG. 13A or FIG. 13B. In the boundary portion E81 between the nozzle groups 81 and 82, a nozzle at the Y1-side end of the nozzle array 82A and a nozzle at the Y2-side end of the nozzle array 81B are adjacent each other in the X direction and their ink droplet landing positions have the following relationship. A dot formed by an ink droplet ejected from a nozzle at the Y2-side end in the Y direction of the nozzle array 81B and a dot formed by an ink droplet ejected from a nozzle at the Y1-side end of the nozzle array 82A partly overlap each other to form a merged dot. The landing time difference between these two dots correspond to the distance L3. This distance L3 is set almost equal to the distance L2 when a print medium is moved at a constant speed through a position facing the print head that is performing a printing operation. So, the merged dot formed by the nozzles in the boundary portion E81 as well as the merged dot formed by being ejected from the nozzles in nozzle arrays 81A and 81B, the nozzle arrays being spaced apart to each other by a distance L2, are formed in gourd-like shape as shown in FIG. 13A or 13B.

What is meant by the expression "almost equal" is as follows. In a configuration where printing is performed in one pass of a print medium relative to the print head, the distance is "almost equal" to the distance to such an extent that the merged dot formed by ink drops, ejected from two nozzles both in one nozzle group or one in each of two adjacent nozzle groups and close to each other in the relative movement direction of the print medium and the print head (X direction), is formed with same shape and density.

Therefore, the merged dots formed by the nozzles in the boundary portion E81 and the merged dots formed by the nozzles in each of the nozzle groups 81, 82 are almost equal in shape and optical density in their overlapping portion. As a result, no density variation-caused lines are formed and a satisfactory image quality can be obtained.

The nozzle groups may be arranged so that they overlap at their ends. In the boundary portion E82 between the nozzle groups 82 and 83, the nozzle arrays of the two groups partly overlap in the Y direction. That is, in the boundary portion E82, a few nozzles at the lower end portion of the nozzle array 82A and a few nozzles at the upper portion of the nozzle array 83A occupy the same positions in the Y direction. A few nozzles at the lower end portion of the nozzle array 82B and a few nozzles at the upper end portion of the nozzle array 83B occupy the same positions in the Y direction.

In this boundary portion E82, a nozzle at the Y1-side end in the Y direction of the nozzle array 83A first ejects an ink droplet, followed by a nozzle at the Y1-side end of the nozzle array 83B, followed by a nozzle at the Y2-side end in the Y direction of the nozzle array 82A and then by a nozzle at the Y2 side end in the Y direction of the nozzle array 82B in that order so that dots formed by these nozzles are successively formed to overlap each other in the Y direction. In this process, of the nozzles at the Y2-side end in the Y direction of the nozzle arrays 82A, 82B, those overlapping the Y1-side end in the Y direction of the nozzle arrays 83A, 83B include active or enabled nozzles (used for ejection) and inactive or disabled nozzles (not used for ejection). Desired active nozzles can be selected from these overlapping nozzles. That is, the nozzle selection is made such that the nozzles selected in the boundary portion E82 to form four dots adjoin at a pitch of 8C in the Y direction and that no two ink droplets land at the same position for one dot. This nozzle selection enables the landing time differences between the four ink droplets ejected from the selected nozzles in the boundary portion E82 to match the distances L2 and L3, thus eliminating the density variation-caused lines.

Likewise, in the boundary portion E83 too, the density variation can be prevented as in the boundary portion E81.

As described above, the elongate print head 80 according to the first embodiment makes it possible to form an image at high speed and reliably prevent the formation of density variation-caused lines in the image. Further, since the elongate print head of the first embodiment is constructed by arranging short nozzle groups in a staggered pattern, it can be manufactured easily at low cost.

Second Embodiment of this Invention

Next, a second embodiment of this invention will be explained by referring to FIG. 10.

A print head 90 in the second embodiment is an elongate print head which, as in the first embodiment, has a plurality of nozzle groups of the same construction (four nozzle groups 91, 92, 93, 94) arranged staggered. It is noted, however, that two nozzle arrays making up each nozzle group differ from those of the first embodiment.

Let us take a nozzle group 91 for example. Nozzle arrays 91A, 91B in the nozzle group 91 each have their nozzles arranged staggered.

The nozzle array 91A has nozzle array forming elements 91A1, 91A2 arrayed in a staggered manner along two parallel limes a small distance L4 apart in the X direction. Like the nozzle array 91A, the nozzle array 91B has two lines of nozzle array forming elements 91B1, 91B2 and is arranged parallel to the nozzle array 91A. In each of these nozzle arrays the nozzles are arranged at a pitch of 9B. Further, the nozzles in the nozzle array 91B are situated intermediate between the nozzles of the other nozzle array 91A. Therefore, when viewed as a whole, the nozzle group 91 has a nozzle pitch of 9C (=9B×½) in the Y direction. Other nozzle groups have the similar construction.

The nozzle array forming elements in the nozzle group 91 and the nozzle array forming elements in the nozzle group 93 are arrayed in the same straight lines running in the Y direction; and the nozzle array forming elements in the nozzle group 92 and the nozzle array forming elements in the nozzle group 94 are also arrayed in the same straight lines running in the Y direction.

Figure 10:
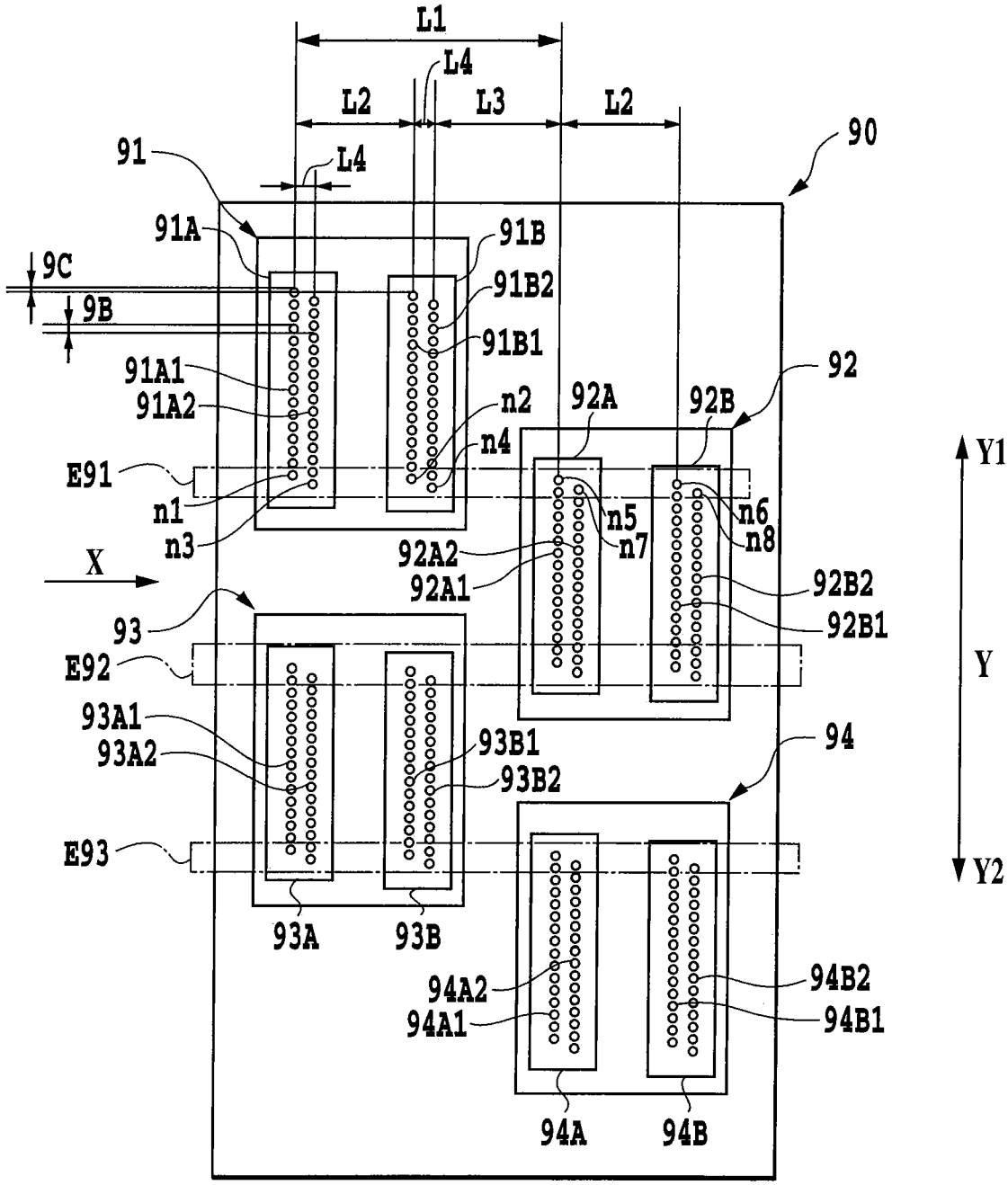
FIG. 10 is a schematic diagram showing a nozzle array of an elongate print head in a second embodiment of this invention.

In FIG. 10, L1 denotes a distance in the X direction between the upstream side nozzle array forming elements 91A1, 93A1 in the nozzle groups 91, 93 situated on the upstream side with respect to the X direction and the upstream side nozzle array forming elements 92A1, 94A1 in the downstream side nozzle groups 92, 94. L2 denotes a distance in the X direction between adjoining nozzles in each nozzle group. L3 denotes a distance in the X direction between the downstream side nozzle array forming elements 91B2, 93B2 of the upstream side nozzle groups 91, 93 and the upstream side nozzle array forming elements 92A1, 94A1 of the downstream side nozzle groups 92, 94 (also referred to as a nozzle group distance in the X direction). The distances L2 and L3 are set almost equal.

In a boundary portion E91 between the nozzle group 91 and the nozzle group 92, nozzles n1, n2, n3, n4 situated at the lower end of the nozzle array forming elements 91A1, 91B1, 91A2, 91B2 are set close to each other successively in that order in the Y direction. Immediately below the nozzle n4 at the lower end of the nozzle array forming element 91B2 are nozzles n5, n6, n7, n8 that are situated at the upper end of the nozzle array forming elements 92A1, 92B1, 92A2, 92B2 and are set close to each other successively in that order in the Y direction. These eight nozzles successively eject ink droplets to form dots, with the adjoining dots partly overlapping to form merged dots.

Distances in the X direction between adjoining nozzles in the same nozzle group are all L2 and thus landing time difference between the adjoining nozzles are uniform Thus, the merged dots formed by the adjoining nozzles are gourd-shaped, as shown in FIG. 13A or FIG. 13B. The distance between the nozzle n4 at the lower end of the nozzle array forming element 91B2 and the nozzle n5 at the upper end of the nozzle array forming element 92A1 is L3. This distance L3 is set nearly equal to the distance L2. Therefore, the landing time difference between the ink droplets ejected from the adjoining nozzles n4 and n5 is nearly equal to the landing time difference between ink droplets ejected from other adjoining nozzles.

As a result, the merged dots formed by ink droplets ejected from the nozzles n1-n8 are all gourd-shaped, as shown in FIG. 13A or FIG. 13B, and the optical density of an overlapping portion in each gourd-shaped merged dot is uniform. Therefore no density variation-caused lines are formed in a printed image.

The overlapping configuration like the one described above may also be adopted. For example, in the boundary portion E92, a few nozzles at the Y1-side end portion of the nozzle array forming elements 93A1, 93A2, 93B1, 93B2 and a few nozzles at the Y2-side end portion of the nozzle array forming elements 92A1, 92A2, 92B1, 92B2 partly overlap in the Y direction. Among these nozzles in the boundary portion E92 a nozzle selection is made such that the nozzles selected to form eight dots adjoin at a pitch of 9C in the Y direction and that no two ink droplets land at the same position for one dot. This nozzle selection enables the landing time differences between the eight ink droplets ejected from the selected nozzles in the boundary portion E92 to match the almost equal distances L2 and L3, thus eliminating the density variation-caused lines.

Also in the boundary portion E93, as in the boundary portion E91, density variations can be prevented. Where a high-density nozzle arrangement is used as in this embodiment, the volume of ink ejected from each nozzle during the printing operation is smaller than when the adjoining nozzles are arranged at a larger pitch. More precisely, the ink ejection volume is determined so that a dot formed has a diameter of about $\sqrt{2}\times$nozzle pitch.

Third Embodiment of this Invention

Figure 11:
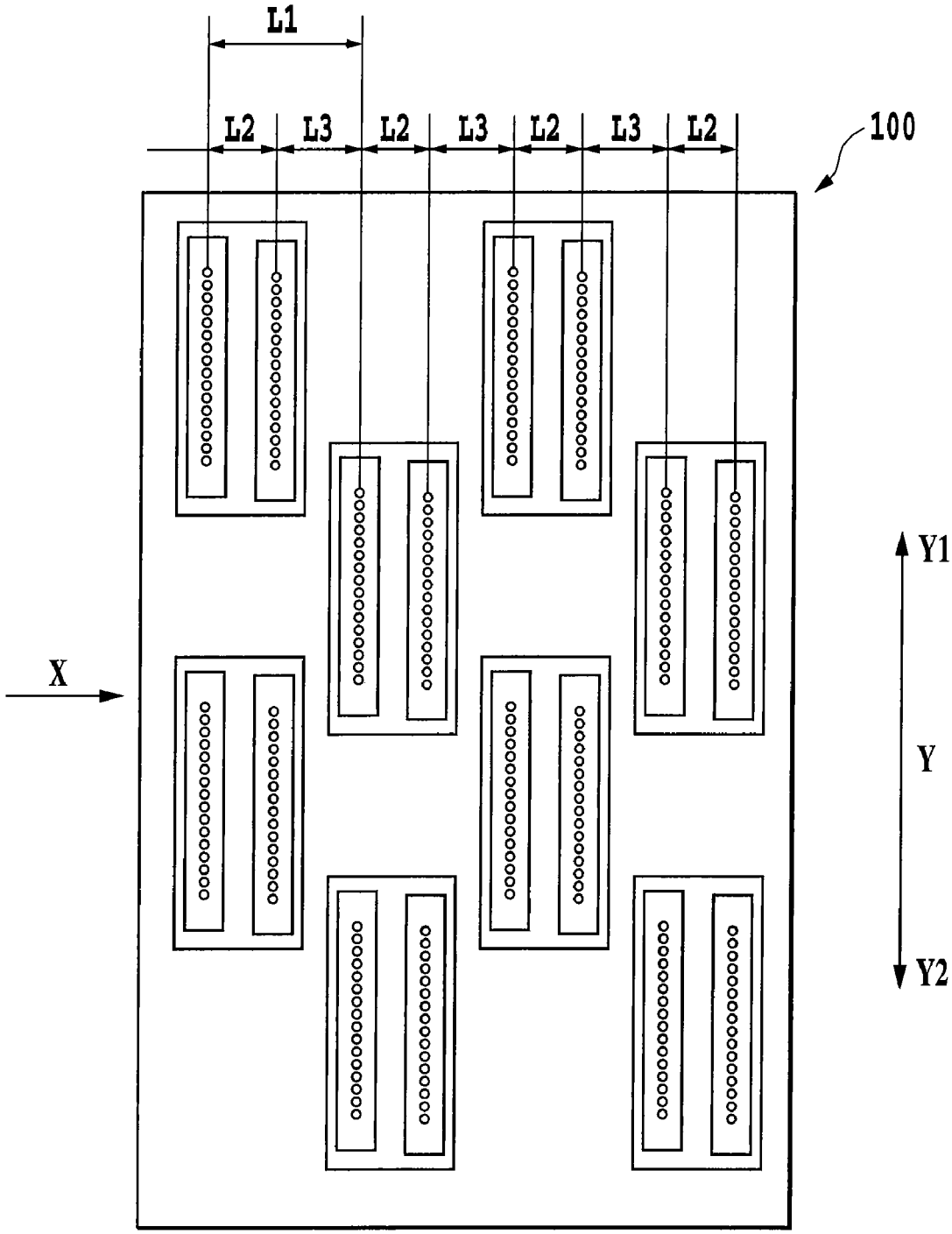
FIG. 11 is a schematic diagram showing a nozzle array of an elongate print head in a third embodiment of this invention.

FIG. 11 shows a third embodiment of this invention. A print head 100 shown here has two sets of those nozzle groups used in the first embodiment of FIG. 9 arranged side by side in the X direction. With this arrangement, the similar effect to that of the above embodiments can be expected and adjoining dots stably form merged dots of the shape of FIG. 13A.

Fourth Embodiment of this Invention

Figure 12:
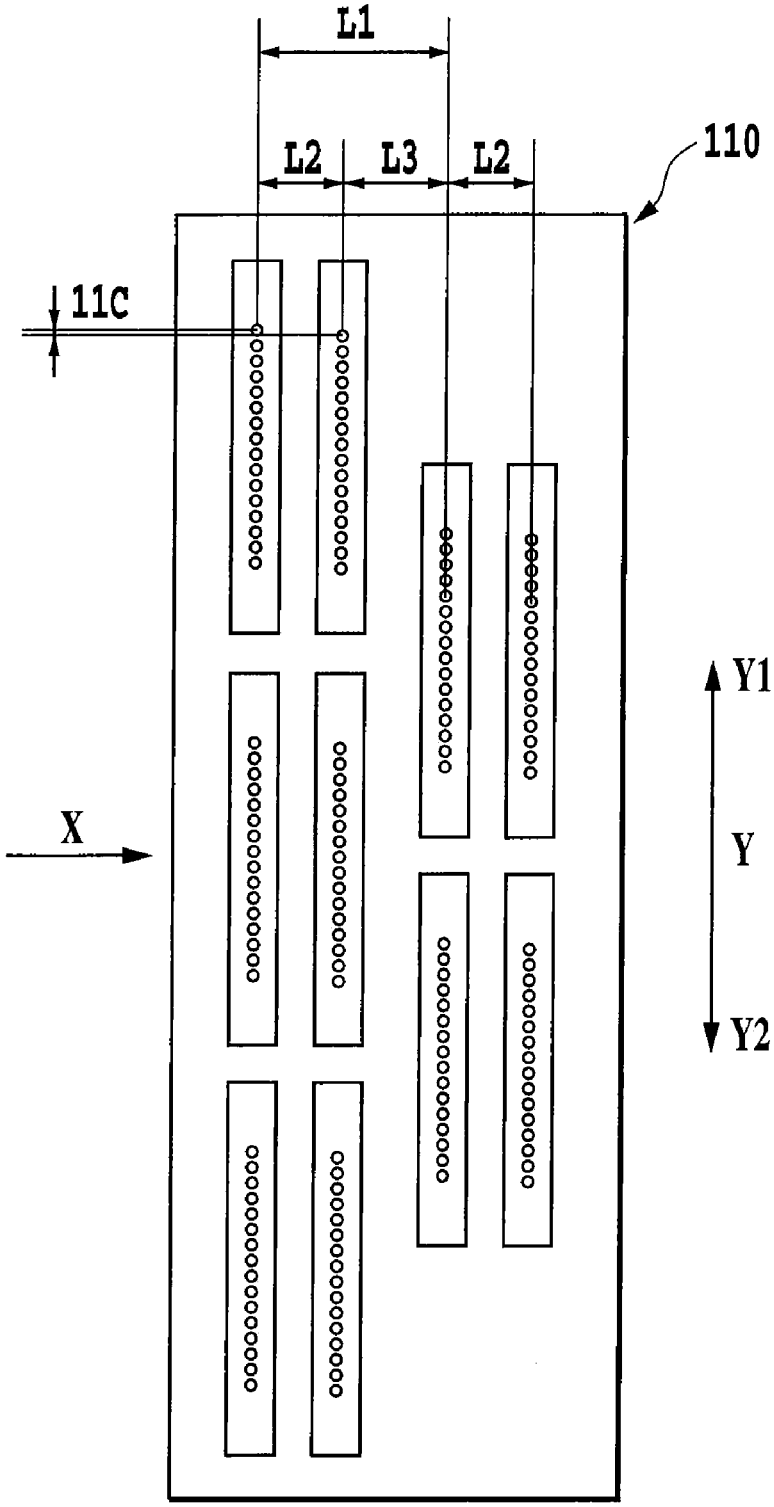
FIG. 12 is a schematic diagram showing a nozzle array of an elongate print head in a forth embodiment of this invention.

FIG. 12 shows a fourth embodiment of this invention. In a print head 110 shown here, each of nozzle groups comprises a single array of nozzles. These nozzle arrays are arranged in pairs so that two in each pair oppose each other in the X direction with a distance L2 in between. The paired nozzle arrays are so set that the nozzles in one array and the nozzles in the other are staggered in the Y direction by a pitch 11C. Further, these nozzle pairs are arranged staggered between two parallel lines extending in the Y direction in such a way that the paired nozzle arrays situated on the upstream side with respect to the X direction and the paired nozzle arrays situated on the downstream side partly overlap at their upper and lower ends in the Y direction.

In this embodiment also, since the adjoining nozzles successively form adjoining dots at time intervals corresponding to the almost equal distances L2 and L3, merged dots formed by these adjoining dots have a uniform optical density which in turn leads to a high quality image.

Other Embodiments

While in the above embodiments a full-line type print head has been taken up as an example, this invention is also applicable to a so-called serial type ink Jet printing apparatus which moves a print head in a direction crossing the print medium transport direction as the print head prints on the print medium. In that case, this invention is effective not only for a one-pass printing, which completes the printing in any one image area in one printing scan (pass), but also for a multi-pass printing, which completes the printing in any one image area in a plurality of printing scans.

In the above embodiments, an ink jet printing apparatus has been described which uses a print head ejecting ink droplets of a constant ink volume. This invention is also applicable to a print head having nozzles capable of ejecting ink droplets of different ink volumes. Further, this invention can also be applied to a print head which, in addition to yellow, cyan, magenta and black inks, ejects light or dark inks of the same colors with different densities.

This invention is particularly advantageous when applied to a printing apparatus that uses an ink jet print head which utilizes thermal energy in ejecting ink from nozzles as flying ink droplets for printing.

The serial type ink jet printing apparatus are available in a variety of configurations. For example, in one configuration, the print head is secured to the printing apparatus body; in another configuration a replaceable chip type print head is replaceably mounted on the printing apparatus body for electrical connection with and for ink supply from the apparatus body; and in still another configuration a cartridge type print head is integrally attached with an ink tank. This invention is effectively applied to any of these configurations.

Example Printing Operations

This invention will be explained in more detail in example printing operations.

Example Operation 1

In this example, a printing operation was performed by using the elongate print head 80 of FIG. 9 as the ink jet print head of FIG. 1 in this elongate print head 80, an upstream nozzle array and a downstream nozzle array making up each nozzle group were constructed to have a nozzle density of 600 dpi. More specifically, head chips of on-the-shelf BJF850 cartridges (Canon make) were combined and only those nozzle groups arranged as shown in FIG. 9 were used to construct an elongate print head. Thus, each nozzle group has 256 nozzles arranged at a pitch of 1200 dpi. Four of the nozzle groups of the above construction were shifted alternately to the upstream side and to the downstream side for a staggered arrangement.

This elongate print head was used on an ink jet printing apparatus to eject ink droplets containing a predetermined colorant to form dots on a print medium. The ink was ejected in droplets each 4.5±0.5 pl in volume. Ink dedicated for BJF850 cartridge (Canon make) was used as the ink containing a colorant.

Photo-glossy paper dedicated for ink jet (Pro-photo paper, PR101: Canon make) was prepared as a print medium.

An ejection drive frequency at which ink droplets were ejected from the print head nozzles was set at 8 kHz.

Image data was printed in one printing scan of the elongate print head 80. No optical density difference was observed between an image printed by those nozzles in the boundary portion between the staggered nozzle groups and an image printed by other nozzles, and an image produced was uniform in density.

Example Operation 2

Four of the above elongate print heads were used to print a pattern of grayscale steps as a full-color image with a maximum ink volume of 200% (up to two 4.5-pl ink dots were used for each pixel in a print matrix of 1200 dpi). As with the example operation 1, no density difference was observed between an image printed by those nozzles in the boundary portion of different nozzle groups and an image printed by other nozzles.

Example Operation for Comparison

In place of the elongate print head used in the example operation 1, an elongate print head shown in FIG. 5A was used in one-pass printing. In this printing, an image printed by those nozzles in the boundary portion of different nozzle groups was found to have density variation-caused lines and its quality was degraded.

As described above, these example operations can thoroughly eliminate the conventional problems experienced during the printing operation using an elongate print head that is made by combining nozzle groups of relatively short nozzle arrays. That is, merged dots formed by ink droplets ejected from adjoining nozzles in the boundary portions between the, nozzle groups can be made equal in optical density to merged dots formed by adjoining nozzles in an interior of each nozzle group. This in turn prevents the formation of density variation-caused lines, assuring a good quality image.

Further, arranging both the nozzle arrays and the nozzle groups in a staggered configuration can not only array nozzles in the print head at high density but also locate the nozzles in each nozzle group at more precise positions than when longer nozzle groups are individually arranged on a substrate. This staggered arrangement also makes the wiring of signal lines connecting to the nozzle groups easy and therefore minimizes an increase in the size of the print head in the width direction of the print medium. Further, this arrangement renders the manufacture of the print head extremely easy when compared with a configuration in which nozzles are highly densely arrayed in a single array, significantly reducing the manufacturing cost.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application Nos. 2003-417361 filed Dec. 15, 2003 and 2004-308822 filed Oct. 22, 2004, which are hereby incorporated by reference herein.

What is claimed is:

1. An ink jet printing head comprising:

four nozzle groups, with each nozzle group being provided with a plurality of nozzle arrays and each nozzle array being provided with a plurality of nozzles which are configured to eject ink and are arranged along a first direction, wherein, of the four nozzle groups, a first nozzle group, a second nozzle group, a third nozzle group and a fourth nozzle group are arranged in the first direction in order of the first nozzle group, the second nozzle group, the third nozzle group and the fourth nozzle group, wherein the first nozzle group and third nozzle group are aligned in the first direction and the second nozzle group and fourth nozzle group are aligned in the first direction, wherein the first nozzle group and the second nozzle group are arranged adjacently to each other in a second direction perpendicular to the first direction, the second nozzle group and the third nozzle group are arranged adjacently to each other in the second direction, and the third nozzle group and the fourth nozzle group are arranged adjacently to each other in the second direction, wherein only end portions of the nozzle arrays in the nozzle groups adjacent to each other overlap each other in the second direction, and wherein a distance in the second direction between adjacent nozzle arrays in each nozzle group is equal to a distance in the second direction between a first nozzle array of one nozzle group and a second nozzle away of another nozzle group of the nozzle groups adjacent one another in the second direction, the first nozzle array being on a side closest to the other nozzle group and the second nozzle array being on a side closest to the one nozzle group.

2. An ink jet printing head according to claim 1, wherein the plurality of nozzle groups are arranged in a staggered pattern in the first direction.

3. An ink jet printing head according to claim 1, wherein the plurality of nozzles of each nozzle group are arranged in a staggered pattern in the first direction.

* * * * *